United States Patent [19]

Dostal et al.

[11] 4,194,784

[45] Mar. 25, 1980

[54] BENCH BACK REST CONVERTIBLE TO LOCKED TABLE TOP

[75] Inventors: Gerald A. Dostal, Fonda; Richard S. Havlick, Gloversville, both of N.Y.

[73] Assignee: N. A. Taylor Co., Inc., Gloversville, N.Y.

[21] Appl. No.: 871,701

[22] Filed: Jan. 23, 1978

[51] Int. Cl.[2] ..... A47B 85/04

[52] U.S. Cl. ..... 297/126; 403/95

[58] Field of Search ..... 403/85, 92, 374, 319, 403/324, 328, 330, 409, 95; 312/258, 240; 248/240.4, 240.1, 240.2; 297/124, 126

[56] References Cited

U.S. PATENT DOCUMENTS

| | | | |
|---|---|---|---|
| 1,784,108 | 12/1930 | Pearson | 403/324 X |
| 2,673,775 | 3/1954 | Silverman | 403/409 X |
| 3,419,295 | 12/1968 | Small | 403/92 |

*Primary Examiner*—Wayne L. Shedd

*Attorney, Agent, or Firm*—Joseph P. Flanagan

[57] ABSTRACT

The present invention relates to an improved apparatus for use in connection with a convertible table, seat structure whereby the back portion of the seat can be moved to a position relative to the seat portion of the seat such that the back portion functions as a table top and incorporates a locking device for securely locking the back portion of the seat when such back portion of the seat has been moved to its table top position.

3 Claims, 6 Drawing Figures

BENCH BACK REST CONVERTIBLE TO LOCKED TABLE TOP

The present invention relates to a combination table seat structure and more particularly to a table seat structure of a type which, when the parts are arranged in one position relative to each other the structure forms a seat or bench assembly while when the parts are positioned in a different relative position to each other the structure forms a table and seat structure.

The primary object of this invention is the provision of a combination table/seat structure having a common member which can function as both a seat back as well as a table top depending upon such common member's relative position to the seat portion of the device and wherein the structure includes novel locking means to securely lock the common member when it is in position to function as a table top.

This above object as well as other objects and advantages of the invention will become more readily apparent from the following detailed description taken in connection with the accompanying drawings wherein FIG. 1 is a perspective view of structure incorporating the instant invention in its table assuming position.

Figure 1:
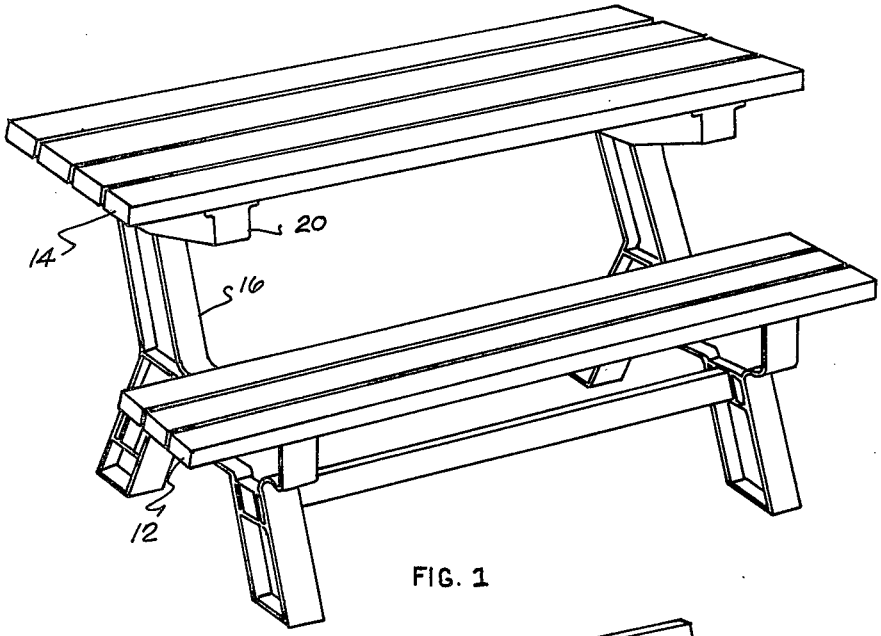

Referring to FIG. 1, there is shown a picnic table assembly comprising a seat member 12 and a table member 14. The seat member may be mounted in any conventional way on suitable leg structure while the table member is pivotally carried, as hereinafter described, on an upstanding stanchion member 16.

The upstanding stanchion member 16 is provided with structure 17 forming a passageway for the reception of a connecting member 18. The member 18 supports, for rotational movement thereon, a bracket member 20 which supports the table structure 14.

Slidably associated with the crossarm member 20 is a locking member 24 carrying, on its underside, an irregularly shaped wedge portion 25.

Figure 2:
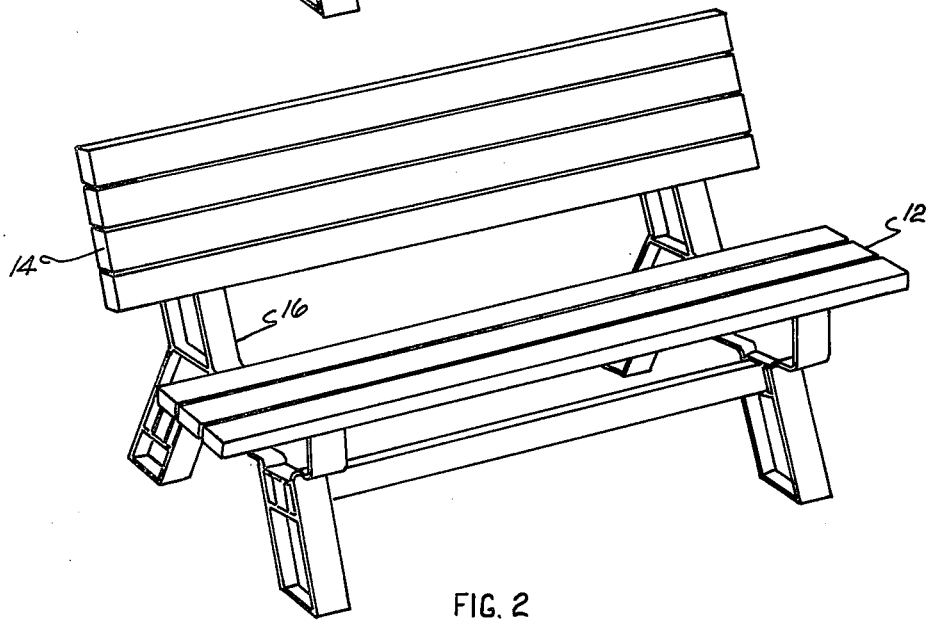
FIG. 2 is a view similar to FIG. 1 showing structure incorporating the instant invention in its bench assuming position.
Figure 3:
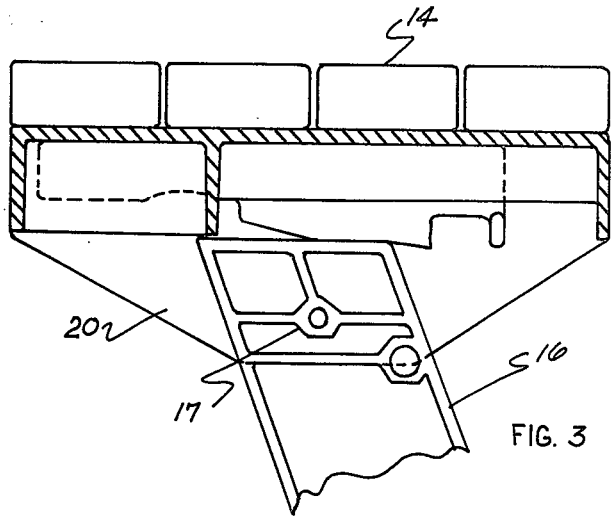
FIG. 3 is a section view of the locking device of the instant invention.
Figure 4:
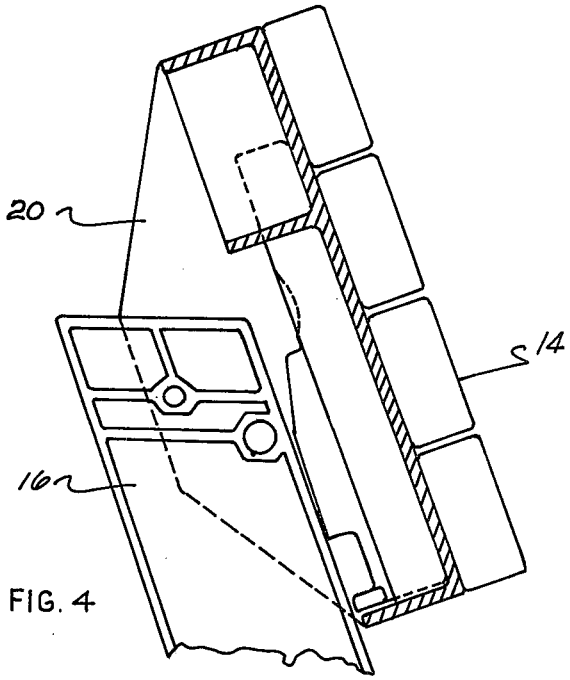
FIG. 4 is a section view of the locking device of the instant invention.

The wedge-shaped locking member is utilized, when the assembly is in the position of FIG. 1, to firmly support and lock the table element 14 in its FIG. 1 position while, when it is desired to convert the table member to act as the back of the bench member, as shown in FIG. 2, the wedge-shaped locking member is slidably moved from its engagement with the upper surface of the stanchion 16 to permit rotation of the crossarm member 20 in a clockwise position, FIGS. 3 and 4, whereupon the member 14 will form the back rest for the bench structure.

Should it be desired to convert the bench assembly to the table assembly, the crossarm is merely rotated counterclockwise from its FIG. 4 position to its FIG. 3 position and the wedge-shaped locking member is slid leftward, FIG. 3, to securely lock the table member 14 in its table forming position.

Figure 5:
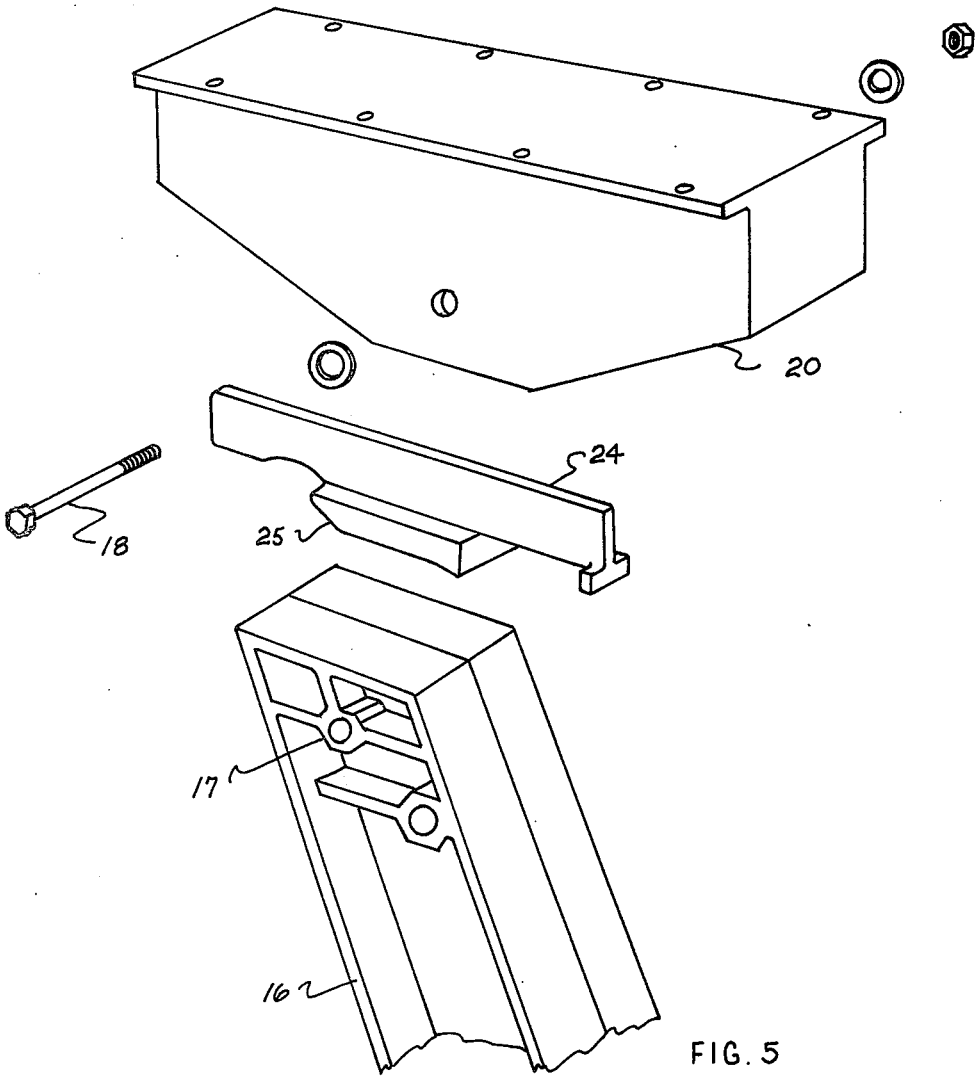
FIG. 5 is an exploded view of the structure forming the locking device of the instant invention.
Figure 6:
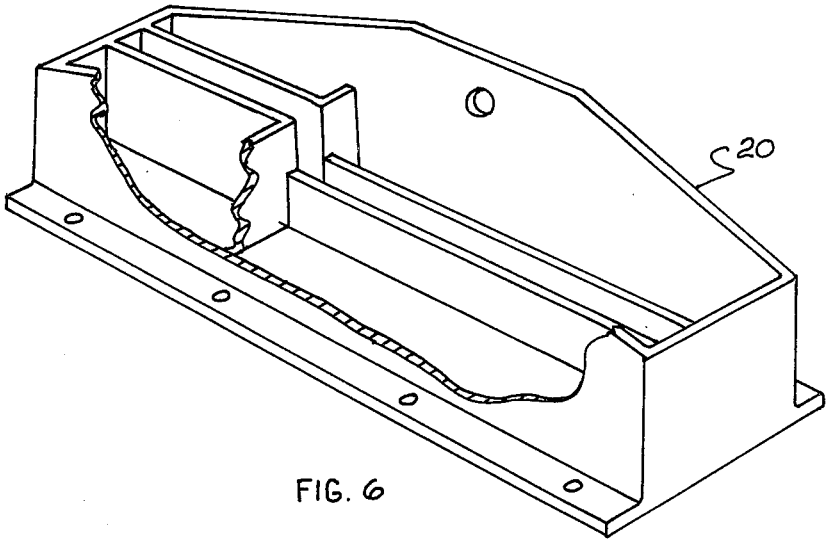
FIG. 6 is a cutaway view of the element 20 of FIG. 5.

The crossarm member 20, as shown in the cutaway view of FIG. 6 wherein the member 20 is in an inverted position relative to its position in FIG. 5, has formed therein a raceway to accommodate the locking member 24. The locking member 24, when moved to locking or unlocking position, moves in this raceway.

Although in the instant disclosure I have shown a preferred embodiment of my invention, a range of alteration, modification, change, and substitution is intended therein and in some instances some features of the invention may be utilized without a corresponding use of other features. Accordingly, it is intended that the claims be construed in a manner consistent with the full range of the spirit and scope of the invention herein.

Having thus described the invention, I claim:

1. A locking device for use on an article of furniture, said article of furniture having frame means carrying a fixed seat member and a movable support member, said support member rotatably movable on said frame from a first non-locked backrest supporting position to a second locked table top position, said support member maintained in its first non-locked backrest supporting position by gravity, said support member maintained in its second locked table top position by said locking device, said locking device secured to said support member and comprising a box-shaped housing member rotatably movably carried on said frame means, wedging means loosely contained between said frame member and said housing member for rotational movement with said housing member, said wedging member rotatably and longitudinally movable from a first gravity maintained un-biased non-wedging position to a second wedging position to lock by wedging action said support member in its second position, said wedging action resulting from said wedging member being slidably moved longitudinally within said housing member to a position where it is wedged between said housing member and a planar portion of said frame member when said support member is in its second position.

2. The invention of claim 1 wherein said housing member is provided with a raceway for guiding said slidable wedging member.

3. The invention of claim 2 wherein said slidable wedging member comprises an elongated member having an upper surface and a lower surface, said lower surface having, intermediate its ends, an arcuate shaped indentation therein and an irregular shaped protrusion thereon.

* * * * *